United States Patent [19]

Suzuki et al.

[11] Patent Number: 4,847,144

[45] Date of Patent: Jul. 11, 1989

[54] THERMOSENSITIVE IMAGE TRANSFER RECORDING MEDIUM

[75] Inventors: Akira Suzuki, Mishima; Kunichika Morohoshi, Numazu, both of Japan

[73] Assignee: Ricoh Company, Ltd., Tokyo, Japan

[21] Appl. No.: 116,053

[22] Filed: Nov. 2, 1987

[30] Foreign Application Priority Data

Nov. 1, 1986 [JP] Japan ..... 61 259624

[51] Int. Cl.[4] ..... B41M 5/26

[52] U.S. Cl. ..... 428/321.5; 428/484; 428/488.1; 428/488.4; 428/913; 428/914

[58] Field of Search ..... 428/195, 335, 336, 522, 428/913, 914, 488.4, 321.3, 321.5, 484, 488.1, 422, 500, 521

[56] References Cited

U.S. PATENT DOCUMENTS 4,624,891 11/1986 Sato et al. ..... 428/914

FOREIGN PATENT DOCUMENTS 189489 9/1985 Japan ..... 428/321.3

*Primary Examiner*—Ellis P. Robinson
*Assistant Examiner*—P. R. Schwartz
*Attorney, Agent, or Firm*—Oblon, Spivak, McClelland, Maier & Neustadt

[57] ABSTRACT

A thermosensitive image transfer recording medium is disclosed, which comprises (i) a support material, (ii) a thermofusible ink layer formed on the support material, comprising (a) a fine porous network structure made of a resin, and (b) a thermofusible ink composition which is held in the fine porous network structure, comprising a thermofusible material which is solid at room temperature, a colorant, and an oil component and (iii) a thermofusible top layer comprising an oleophilic thermofusible material formed on the thermofusible ink layer.

16 Claims, 1 Drawing Sheet

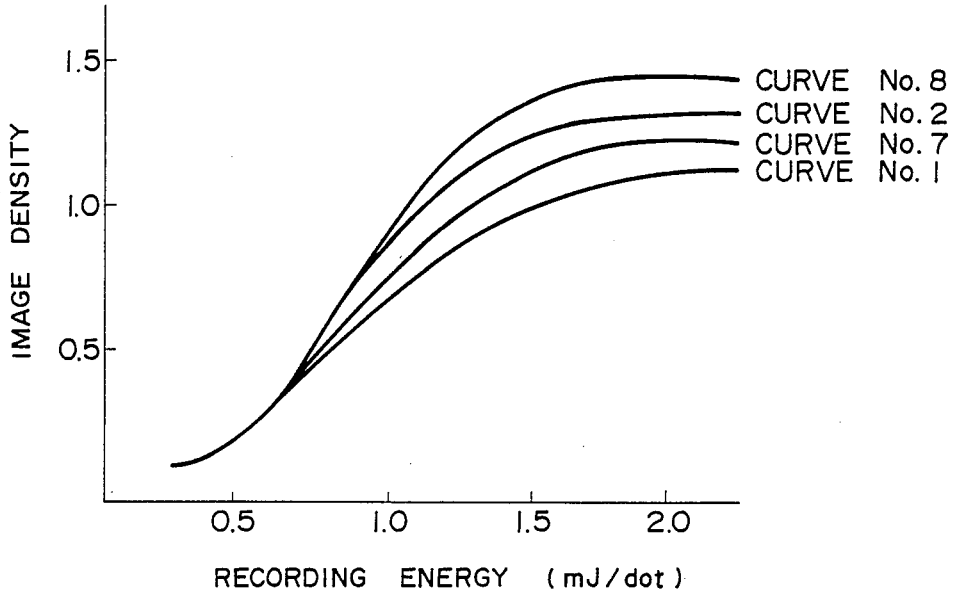
1.5
1.0
0.5
IMAGE DENSITY
CURVE No. 8
CURVE No. 2
CURVE No. 7
CURVE No. 1
0.5
1.0
1.5
2.0
RECORDING ENERGY (mJ/dot)

THERMOSENSITIVE IMAGE TRANSFER RECORDING MEDIUM

BACKGROUND OF THE INVENTION

The present invention relates to a thermosensitive image transfer recording medium capable of forming images having high image density and excellent image gradation, even on a receiving sheet having a rough surface, in particular, on a sheet of plain paper having poor smoothness, by application of heat to a thermofusible ink layer of the recording medium, for instance, through a thermal head or a laser beam application device so as to imagewise transfer a thermofusible ink composition contained in the thermofusible ink layer to the receiving sheet.

More particularly, the present invention relates to a thermosensitive image transfer recording medium comprising (i) a support material, (ii) a thermofusible ink layer formed thereon, comprising (a) a fine porous network structure made of a resin, and (b) a thermofusible ink composition held in the porous network structure, which comprises as the main components a thermofusible material which is solid at room temperature, a colorant and an oil component, and (iii) a thermofusible top layer comprising an oleophilic thermofusible material formed on the thermofusible ink layer.

Conventionally, there are known (i) a thermosensitive image transfer sheet comprising a support material and a sublimable dye layer formed on the support material, and (ii) a thermosensitive image transfer sheet comprising a support material and a thermofusible ink layer comprising a thermofusible material and a pigment which are homogeneously dispersed therein, capable of forming images on a receiving sheet by subjecting the thermosensitive image transfer medium to thermal printing.

The method using a sublimable dye, however, is superior in the reproduction of image gradation, but has the drawbacks that the thermal sensitivity is low and the durability of the reproduced image is poor. On the other hand, the method using a thermofusible material and a pigment is superior in thermal sensitivity and the durability of the produced images, but has the drawback that the image gradation is unsatisfactory.

Furthermore, there has been proposed a thermosensitive image transfer recording medium comprising a support material and a fine porous structure formed thereon, which contains a thermofusible ink composition consisting essentially of (a) a thermofusible material which is solid at room temperature and (b) a colorant. In comparison with the conventional thermofusible type recording media, the above proposed thermosensitive image transfer recording medium is improved on image gradation, but the images transferred to a receiving sheet having a rough surface, for instance, a sheet of plain paper having poor smoothness, are poor image quality and still unsatisfactory for use in practice.

SUMMARY OF THE INVENTION

It is therefore an object of the present invention to provide an improved thermosensitive image transfer recording medium from which the above mentioned shortcomings of the conventional recording media have been eliminated, and which is particularly capable of yielding images with high image density and excellent image gradation, even on a receiving sheet having a rough surface.

The above object of the present invention is attained by a thermosensitive image transfer recording medium comprising (i) a support material, (ii) a thermofusible ink layer formed thereon, which thermofusible ink layer comprises (a) a fine porous network structure made of a resin, (b) a thermofusible ink composition held in the porous network structure, which comprises as the main components a thermofusible material which is solid at room temperature, a colorant and an oil component, and (iii) a thermofusible top layer comprising an oleophilic thermofusible material formed on the thermofusible ink layer.

BRIEF DESCRIPTION OF THE DRAWINGS

In the drawing, the single FIGURE is a graph showing the relationship between the image densities and the recording thermal energy applied thereto per dot in examples of a thermosensitive image transfer recording medium according to the present invention.

DETAILED DESCRIPTION OF THE PREFERRED EMBODIMENTS

As mentioned previously, the thermosensitive image transfer medium according to the present invention comprises (i) a support material, (ii) a thermofusible ink layer formed thereon, which thermofusible ink layer comprises (a) a fine porous network structure made of a resin, (b) a thermofusible ink composition held in the porous network structure, which comprises as the main components a thermofusible material which is solid at room temperature, a colorant and an oil component, and (iii) a thermofusible top layer comprising an oleophilic thermofusible material formed on the thermofusible ink layer.

When heat is applied to the thermofusible ink layer for image formation by means of a thermal head or the like, the thermofusible material is melted, and gradually seeps together with the colorant and the oil component from the fine pores of the network structure, so that the thermofusible ink composition is transferred to a receiving sheet.

The amount of the thermofusible ink composition which seeps out varies in accordance with the amount of thermal energy applied to the image transfer layer. Therefore, the amount of the thermofusible ink composition transferred can be accurately controlled by controlling the amount of thermal energy applied. Accordingly image reproduction with wide-range gradation can be attained, so that a clear image faithful to the original image can be reproduced.

In the above case, when a sheet having high smoothness, for example, synthetic paper or high quality paper is employed as the receiving sheet, the recorded images have sufficiently clear image gradation and high image density. However when the receiving sheet has a relatively rough surface, for instance, 100 seconds or less in terms of Bekk's smoothness, the image gradation will be poor. In particular, in the formation of dots in relatively low image density areas, the saturation image density is insufficient for use in practice. This occurs because the ink is deposited only in the convex portions of the rough surface of the sheet, and almost no ink is deposited in the concave portions. The result is that the recorded image quality is poor.

Under these circumstances, in order to solve the above problems, an oil component is contained in the thermofusible ink layer to decrease the viscosity of the thermofusible ink composition of the ink layer when melted. Furthermore, a thermofusible top layer comprising an oleophilic thermofusible material is formed on top of the thermofusible ink layer. Thus, even when the receiving sheet has a rough surface, for instance, when the surface of the receiving sheet has a smooth of less than 100 seconds, images can be transferred to the receiving sheet with excellent image gradation and high image density.

The reason for this is that the viscosity of the thermofusible ink composition is decreased when melted by the addition of such an oil component, so that the fused ink composition is transferred not only to the convex portions, but also to the concave portions of the surface of the receiving sheet and uniform image transfer to the receiving sheet is performed even when the receiving sheet has a rough surface.

This phenomenon can be explained by using the following Olson-Peel's Formula concerning the osmosis of liquid into a paper including numerous capillaries under application of an external pressure to the paper. This formula indicates the permeating depth d of the liquid into the paper at the moment an external pressure is applied thereto:

$$d = \sqrt{Pr^2t/4\eta}$$

where P represents the external pressure, r represents the diameter of each capillary in the paper, t represents time, and $\eta$ represents the viscosity of the liquid. The above formula indicates that when P, r and t are constant, the permeating depth d of the liquid, that is, the amount of the transferred liquid into the paper, increases as the viscosity $\eta$ of the liquid decreases.

When the viscosity of the melted ink composition is decreased, it may occur that the ink composition is caused to come out from the thermofusible ink layer even at room temperature by some external pressure applied thereto and there is the risk that the receiving sheet could be smeared with the ink composition. In the present invention, however, there is no such risk because of the use of the thermofusible top layer comprising an oleophilic material on top of the thermofusible ink layer, which thermofusible top layer serves as an ink receiving layer and facilitates the transfer of the ink composition to the receiving sheet.

It is preferable that the content of the oil component in the thermofusible ink composition be 20 wt. % or more for reducing the viscosity of the melted thermofusible ink composition.

Conventionally, when the content of such an oil component is 40 wt. % or more in the thermofusible ink composition, the problem that the background of the receiving sheet is smeared by the ink composition during the image transfer process. This problem, however, is solved by use of the thermofusible top layer on top of the thermofusible ink layer.

It is preferable that the thickness of the thermofusible top layer be in the range of 0.5 μm to 10 μm, more preferably in the range of 1 μm to 6 μm.

The amount of thermal energy applied to the thermosensitive recording material may relatively vary in accordance with the materials and components employed in the ink layer and the thickness of the ink layer.

The thermofusible top layer comprises an oleophilic material having a softening or melting point of about 120° C. or less. The thermofusible top layer can be fused and transferred to a receiving sheet and serves as a layer for receiving the ink composition and preventing the background of the receiving sheet from being smeared with the ink composition. When image recording is performed, the thermofusible top layer is first thermally transferred to the receiving sheet and works so as to increase the ink receiving property of the receiving sheet.

Examples of such a material for use in the thermofusible top layer are waxes such as carnauba wax, paraffin wax, microcystalline wax and castor wax; higher fatty acids, metal salts and esters of higher fatty acids such as stearic acid, palmitic acid, lauric acid, aluminum stearate, lead stearate, barium stearate, zinc stearate, zinc palmitate, methylhydroxy stearate, glycerol monohydroxy stearate; homopolymers and copolymers such as polyethylene, polypropylene, polyisobutylene, polyethylene wax, polyethylene oxide, polytetrafluoroethylene, ethylene—acrylic acid copolymer, ethylene—ethyl acrylate copolymer, ethylene—vinyl acetate copolymer, and thermoplastic resins comprising the above homopolymers, copolymers and their derivatives. These materials can be employed either alone or in combination.

For preventing the background of the receiving sheet from being smeared with the ink composition, it is preferable that the thermofusible top layer have a melting point of 70° C. or more. When necessary, calcium carbonate, silica, kaolinite, barium sulfate, and alumina can be added to the thermofusible top layer.

When a surfactant is added to the thermofusible top layer, the thermofusible top layer comes to have an affinity for a polar component such as cellulose contained in the receiving sheet, thus the thermofusible recording material easily comes into close contact with the receiving sheet. Thus, the thermofusible top layer not only works as an ink receiving layer, but also facilitate the transfer of the ink composition to the receiving sheet.

As the surfactants for use in the present invention, cationic surfactants, anionic surfactants, nonionic surfactants, and ampholytic surfactants can be employed.

Specific examples of a cationic surfactant are octadecylamine acetate, alkyl(hardened beef tallow) trimethylammonium chloride, polyoxyetheyne octadecylamine, polyoxyethylene alkyl(beef tallow) amine, and polyamine.

Specific examples of an anionic surfactant are fatty acid sodium salt soap, fatty acid potassium salt soap, stearic acid soap, alkyl ether sulphate (sodium salt), sperm oil, alcohol, sulfuric ester, sodium salt, dodecylbenzene, sodium sulphate, n-dodecylbenzene sodium sulphate (soft type), alkyl(beef tallow) methyl sodium taurinate, oleo-oil methyl sodium taurinate, sodium dioctylsulfosuccinate, and high polymer type anion (polycarboxylic acid).

Specific examples of a nonionic surfactant are polyoxyethylene oleyl ether, polyoxyethylene cetyl ether, polyoxyethylene stearyl ether, polyoxyethylene lauryl ether, polyoxyethylene nonylphenol ether, polyoxyethylene octylphenol ether, polyoxythylene monolaurate, polyoxyethylene monostearate, polyoxyethylene monooleate, polyethylene glycol, beef tallow fatty acid ester, sorbitan monolaurate, sorbitan monopalmitate, sorbitan monostearate, sorbitan monooleate, sorbitan sesquioleate, sorbitan trioleate, polyoxyethylene sorbitan monolaurate, polyoxyethyl sorbitan monostearate, polyoxyethylene sorbitan monooleate, oxyethylene oxypropylene block polymer, glycerol monostearate, and polyoxyethylene distearate.

A specific example of an ampholytic surfactant is dimethylalkyl(coconut) betaine.

The above surfactants can be used alone or in combination.

The above surfactants can be contained in a thermofusible material by any conventional method. For example, any of the surfactants is dispersed in a thermofusible material, or a surfactant is dissolved in an appropriate solvent and the solution of the surfactant is added as an additive to a thermofusible binder component. In this case, it is preferable that the content of the surfact be in the range of 1 to 60 wt. %, more preferably in the range of 5 to 50 wt. %, of the thermofusible material.

As the support material for use in the present invention, conventional films and papers employed in the field of thermosensitive recording can be used. More specifically, heat resistant plastic films made of polyester, polycarbonate, triacetyl cellulose, nylon, and polyimide, cellophane, condenser paper and parchment paper are preferably employed as the support material. When a thermal head is employed as heat application device, it is preferable that the thickness of the support material 1 be about 2 to 15 μm. By contrast, when laser beams are employed as the heat application device, the thickness of the support material is not always restricted to the above mentioned range.

When a thermal head is employed, the heat resistance of the support material can be improved by coating the thermal-head-contacting surface of the support material with a heat resistant protective layer comprising, for instance, silicone resin, fluorine-contained resin, polyimide resin, epoxy resin, phenolic resin, melamine resin or nitrocellulose.

In the present invention, when the support material is made electroconductive so as to generate Joule's heat therein, the ink composition in the thermofusible ink layer can be imagewise transferred to a receiving sheet by application of electric current thereto.

In the present invention, the thermofusible ink layer can be prepared, for example, by the following method. The method of preparation is of course not restricted to this method.

A thermofusible material, a colorant, and an oil component which serves to form fine pores in the network structure when the network structure is formed are mixed and dispersed in a suitable organic solvent using a dispersion device such as an attritor or a ball mill to obtain an ink dispersion (or solution) containing a thermofusible ink composition.

A resin for forming the porous network structure is separately dissolved in an organic solvent or a mixed solvent such as methylethyl ketone and toluene to prepare a solution of the resin.

This solution is mixed with the previously obtained ink dispersion. The mixture is then uniformly dispersed using a blender such as a ball mill. The thus obtained dispersion is then applied to a support material, and dried, so that a thermofusible ink layer, comprising a fine porous network structure made of the resin in which the thermofusible ink composition is held, is formed on the support material.

A humectant and a dispersing agent may be added to the above dispersion to facilitate the dispersion of the thermofusible material, the colorant and the oil component.

In addition, fillers which are usually employed in the conventional resinous paints may be added, as required, to the above dispersion.

As a resin which is formed into a fine porous network structure, thermoplastic resin and thermosetting resin can be employed.

Specific examples of a thermoplastic resin are homopolymers and copolymers of vinyl chloride, vinyl acetate, vinylidene chloride, nitrocellulose, cellulose butyrate, cellulose acetate, acrylic acid, methacrylic acid, acrylic ester and methacrylic acid ester.

Specific examples of a thermosetting resin are phenolic resin, furan resin, formaldehyde resin, urea resin, melamine resin, alkyd resin, unsaturated polyester and epoxy resin.

An alternative method by which the thermofusible ink layer is formed comprises the steps of kneading a material, which is not compatible with the resin for the fine porous network structure, but soluble in a solvent which will not dissolve the resin, together with the resin, applying the kneaded mixture to the surface of a support material to form a resin layer, dissolving the first mentioned material in the solvent to leave the fine porous resin structure on the support material, and filling the previously mentioned ink dispersion into the porous network structure, whereby a thermofusible ink layer having the same structure as that of the first mentioned thermofusible ink layer can be obtained.

As the thermofusible materials which are solid at room temperature for use in the present invention, the thermofusible binder agents which are employed in the conventional thermosensitive image transfer materials can be employed.

Examples of such thermofusible materials are waxes such as carnauba wax, paraffin wax, microcystalline wax and castor wax; higher fatty acids, metal salts and esters of higher fatty acids such as stearic acid, palmitic acid, lauric acid, aluminum stearate, lead stearate, barium stearate, zinc stearate, zinc palmitate, methylhydroxy stearate, glycerol monohydroxy stearate; homopolymers and copolymers such as polyethylene, polypropylene, polyisobutylene, polyethylene wax, polyethylene oxide, polytetrafluoroethylene, ethylene - acrylic acid copolymer, ethylene - ethyl acrylate copolymer, ethylene - vinyl acetate copolymer, and themoplastic resins comprising the above-mentioned polymers and their derivatives. These materials can be employed either alone or in combination.

It is preferable that these thermofusible materials be employed in an amount of 50 to 200 parts by weight to 100 parts by weight of the resin which constitutes the fine porous network structure.

As the oil component for use in the present invention, the following can be employed:

Vegetable oils and animal oils such as cotton oil, rape oil and whale oil, mineral oils such as motor oil, spindle oil and dynamo oil.

Further, as such an oil component, lanolin fatty acid oil, lanolin fatty acid metal salt oil such as lanolin fatty acid calcium salt oil, and lanolin fatty acid ester oil can also be employed. Specific examples of such oils are Neocoat OES-181, OES-183, LFC-50M and LS-3102MB (made by Yoshikawa Oil & Fat Co., Ltd.). Such oil components may be added in an amount of 20 parts by weight or more to decrease the viscosity of the thermofusible ink composition when melted. Alternatively, the following low-viscosity oils having a viscosity of 300 cps or less at 25° C. may be added for attaining more uniform and more smooth image transfer onto a receiving sheet having a rough surface.

(1) Esters derived from higher alcohols and the following fatty acids:

| Trademark | Fatty Acids | Viscosity (cps/25° C.) |
|---|---|---|
| HISORATE = 4 | Ricinoleic Acid | 53.6 |
| HISORATE = 5 | Isocaprylic Acid | 8.8 |
| HISORATE = 7 | "Versatic" Acid | 12.7 |
| HISORATE = 10 | Isostearic Acid | 24.3 |
| HISORATE = 11 | Stearic Acid | 20.0 |
| HISORATE = 22 | 12-hydroxystearic Acid | 51.4 |
| HISORATE = 101 | Capric Acid | 22.2 |
| HISORATE = 105 | Isocaprylic Acid | 24.2 |
| HISORATE = 107 | "Versatic" Acid | 36.8 |
| HISORATE = 108 | "Dimer Acid" | 36.0 |
| HISORATE = 110 | Isostearic Acid | 56.0 |
| HISORATE = 111 | Stearic Acid | 36.8 |
| HISORATE = 117 | Oleic Acid | 80 |
| HISORATE = 122 | 12-hydroxystearic Acid | Paste |

(2) Hydroxy Fatty Acid Esters

| Trademark | Composition | Viscosity (cps/25° C.) |
|---|---|---|
| CO-FA Methyl | Methyl Ricinolate | 40 |
| CO-FA Methyl-D | Methyl Ricinolate (distilled) | 30 |
| CO-FA Ethyl-D | Ethyl Ricinolate (distilled) | 30 |
| CO-FA Butyl | Butyl Ricinolate | 40 |
| MAR | Methylacetyl Ricinolate | 13 |
| BAR | Butylacetyl Ricinolate | 17 |

(3) Others

| Materials | Viscosity (cps/25° C.) |
|---|---|
| Soybean Oil | 120 |
| Peanut Oil | 150 |
| Liquid Paraffin | 250 |

The above oil components contain volatile components (at 120° C.) in an amount of 1.0 wt. % or less. The esters derived from higher alcohols given in (1) are most preferable for use in the present invention in view of the use of the thermosensitive image transfer recording medium over an extended period of time.

As the colorant for use in the present invention, the following dyes and pigments are preferably employed for obtaining images with excellent image gradation:

Examples of such dyes are direct dyes, acid dyes, basic dyes, mordant dyes, sulfur dyes, building dyes and azoic dyes, oil dyes.

Specific examples of the above dyes are as follows:

(1) Direct Dyes:
Direct Sky Blue and Direct Black W (2) Acid Dyes:
Tartrazine, Acid Violet 6B and Acid Fast Red 3G (3) Basic Dyes:
Safranine, Auramine, Crystal Violet, Methylene Blue, Rhodamine B and Victoria Blue B.

(4) Mordant Dyes:
Sunchromine Fast Blue MB, Eriochrome Azurol B and Alizarin Yellow (5) Sulfur Dyes:
Sulphur Brilliant Green 4G (6) Building Dyes:
Indanthrene Blue (7) Azoic Dyes:
Naphthol AS (8) Oil Dyes:
Nigrosin, Spirit Black EB, Varifast Orange 3206, Oil Black 215, Butter Yellow, Sudan Blue II, Oil Red B and Rhodamine B It is preferable that these dyes be in a dissolved state.

As the pigments for use in the present invention, finely-divided pigments and monoazo dyes can be employed.

Specific examples of such finely-divided pigments are the following pigments which are commercially available from Hoechst:
Permanent Yellow GG 02 (C.I. Pigment Yellow 17),
Permanent Yellow DHG trans 02 (C.I. Pigment Yellow 12),
Novoperm Yellow HR 03 (C.I. Pigment Yellow 83),
Hansa Brilliant Yellow 5GX 02 (C.I. Pigment Yellow 74),
Permanent Orange RL 01 (C.I. Pigment Orange 34),
Novoperm Red HFG (C.I. Pigment Orange 38),
Novoperm Red HFT (C.I. Pigment Red 175),
Permanent Lake Red LCLL 02 (C.I. Pigment Red 53:1),
Novoperm Red HF 4B (C.I. Pigment Red 187),
Permanent Carmine FBB02 (C.I. Pigment Red 146),
Permanent Rubine L 6B (C.I. Pigment Red 57:1),
Hostaperm Pink E trans (C.I. Pigment Red 122), and
Reflex Blue R50 (C.I. Pigment Blue 61).

Further, in the present invention, the following monoazo pigments having the following general formula can also be used as colorant:

X—N=N—Y where X represents a diazonium salt moiety and Y represents a coupler moiety.

(1) Sico Fast Yellow D 1355 (made by BASF)
(2) Sico Fast Yellow D 1250 (made by BASF)
(3) Lake Red LC (made by Hoechst) having the formula:

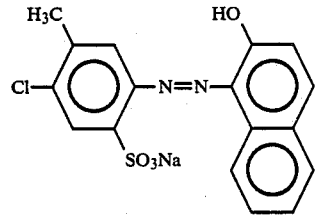

(4) Lake Red C 405 (made by Dainichi Seika Color and Chemicals Mfg. Co., Ltd.)
(5) Fast Red 1547 (made by Dainichi Seika Color and Chemicals Mfg. Co., Ltd.) having the formula:

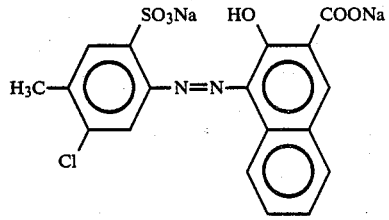

Apart from the previously mentioned low viscosity oils, auxiliary oils for the formation of the porous structure can be employed.

In the present invention, an image gradation control agent can also be added to the thermofusible ink layer in order to improve the image gradation of the images to be obtained.

The image gradation control agent for use in the present invention is more wetting and more compatible with the resin for the fine porous network structure than with the main components of the thermofusible ink composition such as the oil components and the thermofusible materials and is firmly held within the fine porous network structure and functions to precisely control the amount of the thermofusible ink composition transferred from the thermofusible ink layer. It is considered that the image gradation control agent is able to precisely control the surface pore diameter of the fine porous network structure so as to make the pore diameter small, and when thermal energy is applied to the image gradation control agent, the image gradation control agent remains in the fine porous network structure, without being transported outside the porous network structure, thereby controlling the amount of the thermofusible ink composition transferred from the thermofusible ink layer. Further, the image gradation control agents, when added to the thermofusible ink layer, works to make the surface of the ink layer smooth to attain more close contact with the receiving sheet. Therefore, as such image gradation control agents, any materials can be employed as long as they work in the above-described manner. Specific examples of such image gradation control agents may be, but not restricted to, the following:

(a) Needle-like Pigments as disclosed in Japanese Laid-Open Patent Application No. 60-38868

(b) Azo Pigments as disclosed in Japanese Laid-Open Patent Application No. 60-192098

(c) Phthalocyanine Pigments as disclosed in Japanese Laid-Open Patent Application No. 60-168562

It is preferable that the amount of the image gradation control agent be 0.5 to 10 parts by weight, more preferably 1 to 5 parts by weight, to 1 part by weight of the colorant in the thermofusible ink layer.

In order to more firmly fix the above described porous network structure to the support material, thereby obtaining images with excellent image gradation, an intermediate layer may be interposed between the support material and the thermofusible ink layer. Such intermediate layer can be made of a plastic resin or a filler-containing plastic resin.

As the receiving sheet to be used in combination with the thermosensitive image transfer recording medium according to the present invention, conventional plain paper and synthetic paper can be employed. In order to facilitate the transfer of the coloring agent from the image transfer recording medium to the receiving sheet, it is preferable that a filler such as the above-mentioned resins, $TiO_2$, silica or ZnO be contained in such papers.

By referring to the following examples, the present invention will now be explained more specifically:

EXAMPLE 1

A mixture of the following components was dispersed in a ball mill at about 85° C. for about 48 hours:

| | Parts by Weight |
|---|---|
| Carnauba Wax (Carnauba Wax No. 1 made by Noda Wax Co., Ltd.) | 6 |
| Neozapon Blue 807 (Colorant) (made by BASF) | 3 |
| Lanolin Fatty Acid Oil (Neocoat OES-183, made by Yoshikawa Oil & Fat Co., Ltd.) | 8.3 |
| Sorbon T-80 (Non-ionic surfactant, sorbitan monooleate, made by Toho Chemical Industry Co., Ltd.) (Dispersing Agent) | 0.12 |
| Liquid paraffin | 1.25 |
| Methyl ethyl ketone | 20 |
| Toluene | 50 |

To the above dispersion, 45 parts by weight of a 20 wt. % vinyl chloride—vinyl acetate copolymer solution consisting of 9 parts by weight of vinyl chloride—vinyl acetate copolymer, 18 parts by weight of toluene and 18 parts by weight of methyl ethyl ketone were added. The mixture was dispersed for about 1 hour in a ball mill, so that a thermofusible ink layer coating liquid was prepared.

The thus prepared thermofusible ink layer coating liquid was coated by a wire bar on the front side of a polyester film having a thickness of 6 μm, backed with a silicone resin heat resistant layer, and was then dried at 100° C. for 1 minute, so that a thermofusible ink layer having a thickness of about 5 μm was formed on the polyester film.

10 parts by weight of p-benzylbiphenyl (m.p. 84°~86° C.) and 40 parts by weight of toluene were mixed to prepare a thermofusible top layer coating liquid was prepared.

The thus prepared thermofusible top layer coating liquid was coated with a thickness of about 2 μm by a wire bar on the thermofusible ink layer, whereby a thermosensitive image transfer recording medium No. 1 according to the present invention was prepared.

The thermosensitive image transfer recording medium No. 1 was superimposed on a sheet of plain paper having a smoothness of 37 seconds (Xerox Bond Paper 4024) in such a manner that the thermofusible top layer came into close contact with the paper. A thermal head with a recoding density of 6 dots/mm and a recording output of 0.25 W/dot was then applied to the back side of the image transfer recording medium, with the applied thermal energy per dot varied to 0.5 mJ, 1.0 mJ, 1.5 mJ, and 2.0 mJ, so that the image densities of the respective images obtained were measured by a Macbeth densitometer. As a result, images having the image gradation as shown by Curve No. 1 in the single FIGURE were obtained.

EXAMPLE 2

Example 1 was repeated except that the formulation of the thermofusible ink layer coating liquid in Example 1 was changed as shown in Table 1, whereby a thermosensitive image transfer recording medium No. 2 according to the present invention was prepared.

Thermal printing was performed on this thermosensitive image transfer recording mediums in the same manner as in Example 1. As a result, high quality images having the image gradation as shown by Curve No. 2 in the single FIGURE were obtained.

TABLE 1

| Formulation | Example 1 Oil Component (wt. %) 30% | Example 2 Oil Component (wt. %) 55% |
|---|---|---|
| Thermosfusible Material (Carnauba Wax No. 1 made by Noda Wax Co., Ltd.) | 6 | 6 |
| Colorant (Neozapon Blue 807, made by BASF) | 3 | 3 |
| Lanolin Fatty Acid (Oil for forming a porous structure) (Neocoat OES-183, made by Yoshikawa Oil & Fat Co., Ltd.) | 8.3 | 23.7 |
| Dispersing Agent | 0.12 | 0.12 |
| Liquid Paraffin | 1.25 | 1.25 |
| Methyl ethyl ketone | 20 | 20 |
| Toluene | 50 | 50 |

EXAMPLE 3

Example 1 was repeated except that p-dibenzyldiphenyl employed in the thermofusible top layer in Example 1 was replaced with Carnauba Wax No. 1 (m.p. 89° C.) made by Noda Wax Co., Ltd., whereby a thermosensitive image transfer recording medium No. 3 according to the present invention was prepared.

Thermal printing was performed on this thermosensitive image transfer recording mediums in the same manner as in Example 1. As a result, images having almost the same image quality and image gradation as those of the images obtained in Examples 1 and 2 were obtained.

EXAMPLE 4

Example 2 was repeated except that p-dibenzyldiphenyl employed in the thermofusible top layer in Example 1 was replaced with Carnauba Wax No. 1 (m.p. 89° C.) made by Noda Wax Co., Ltd., whereby a thermosensitive image transfer recording medium No. 4 according to the present invention was prepared.

Thermal printing was performed on this thermosensitive image transfer recording mediums in the same manner as in Example 1. As a result, images of the same image quality and image gradation as those of the images obtained in Examples 1 and 2 were obtained.

EXAMPLE 5

A mixture of the following components was dispersed in a ball mill at about 85° C. for about 48 hours:

| | Parts by Weight |
|---|---|
| Carnauba Wax (Carnauba Wax No. 1 made by Noda Wax Co., Ltd.) | 10 |
| Neozapon Blue 807 (Colorant) (made by BASF) | 20 |
| Lanolin Fatty Acid Oil (oil component for forming a porous network structure) (Neocoat OES-183, made by Yoshikawa Oil & Fat Co., Ltd.) | 6 |
| Oleinic acid ester (Low viscosity oil) (Trademark "Hirorate #117, viscosity 8 cps/25° C.) | 25.5 |
| Liquid paraffin | 3 |
| Sorbon T-80 (Non-ionic surfactant, sorbitan monooleate, made by Toho Chemical Industry Co., Ltd.) (Dispersing Agent) | 0.5 |
| Methyl ethyl ketone | 60 |
| Toluene | 120 |

To the above dispersion, 45 parts by weight of a 20 wt. % vinyl chloride—vinyl acetate copolymer solution consisting of 9 parts by weight of vinyl chloride—vinyl acetate copolymer, 18 parts by weight of toluene and 18 parts by weight of methyl ethyl ketone were added. The mixture was dispersed for about 1 hour in a ball mill, so that a thermofusible ink layer coating liquid was prepared.

The thus prepared thermofusible ink layer coating liquid was coated by a wire bar on the front side of a polyester film having a thickness of 6 μm, backed with a silicone resin heat resistant layer, and was then dried at 100° C. for 1 minute, so that a thermofusible ink layer having a thickness of about 5 μm was formed on the polyester film.

10 parts by weight of ethylene—vinyl acetate copolymer and 40 parts by weight of toluene were mixed at 80° C. to prepare a thermofusible top layer coating liquid was prepared.

The thus prepared thermofusible top layer coating liquid was coated with a thickness of about 2 μm by a wire bar on the thermofusible ink layer, whereby a thermosensitive image transfer recording medium No. 5 according to the present invention was prepared.

Thermal printing was performed on this thermosensitive image transfer recording mediums in the same manner as in Example 1. As a result, images of almost the same image quality and image gradation as those of the images obtained in Examples 1 and 2.

EXAMPLE 6

Example 5 was repeated except that the formulation of the thermofusible ink layer coating liquid in Example 5 was changed as shown in Table 2, whereby a thermosensitive image transfer recording medium No. 6 according to the present invention was prepared.

Thermal printing was performed on this thermosensitive image transfer recording mediums in the same manner as in Example 1. As a result, images of almost the same image quality and image gradation as those of the images obtained in Examples 1 and 2 were obtained.

TABLE 2

| Formulation | Example 5 Oil Component (wt. %) 48% | Example 6 Oil Component (wt. %) 66.2% |
|---|---|---|
| Thermosfusible Material (Carnauba Wax No. 1 made by Noda Wax Co., Ltd.) | 10 | 10 |
| Colorant (Neozapon Blue 807, made by BASF) | 20 | 20 |
| Lanolin Fatty Acid (Oil Component for forming a porous network structure) (Neocoat OES-183, made by Yoshikawa Oil & Fat Co., Ltd.) | 6 | 6 |
| Low Viscosity Oil (Oleinic acid ester oil Hisorate #117, 80 cps/25° C.) | 25.5 | 59.5 |
| Dispersing Agent (Sorbon T-80) | 0.5 | 0.5 |
| Liquid Paraffin | 3 | 3 |
| Methyl ethyl ketone | 60 | 60 |
| Toluene | 150 | 150 |

EXAMPLE 7

Example 1 was repeated except that the formulation of the thermofusible top layer coating liquid in Example 1 was changed as follows, whereby a thermosensitive image transfer recording medium No. 7 according to the present invention.

| [Formulation of Thermofusible Top Layer Coating Liquid] | Parts by Weight |
|---|---|
| p-benzylbiphenyl (m.p. 84~ 86° C.) | 10 |
| Surfactant (Trademark "Nissan Nonion op-83RAT" made by Nippon Oils & Fats Co., Ltd.) | 5 |
| Toluene | 50 |

Thermal printing was performed on this thermosensitive image transfer recording mediums in the same manner as in Example 1. As a result, images having the image gradation as shown by Curve No. 7 in the single FIGURE were obtained.

EXAMPLE 8

Example 2 was repeated except that the formulation of the thermofusible top layer coating liquid in Example 2 was changed as follows, whereby a thermosensitive image transfer recording medium No. 8 according to the present invention.

| [Formulation of Thermofusible Top Layer Coating Liquid] | Parts by Weight |
|---|---|
| p-benzylbiphenyl (m.p. 84~ 86° C.) | 10 |
| Surfactant (Trademark "Nissan Nonion op-83RAT" made by Nippon Oils & Fats Co., Ltd.) | 5 |
| Toluene | 50 |

Thermal printing was performed on this thermosensitive image transfer recording mediums in the same manner as in Example 1. As a result, images having the image gradation as shown by Curve No. 8 in the single FIGURE were obtained.

EXAMPLE 9

Example 1 was repeated except that the formulation of the thermofusible top layer coating liquid in Example 1 was changed as follows, whereby a thermosensitive image transfer recording medium No. 9 according to the present invention.

| [Formulation of Thermofusible Top Layer Coating Liquid] | Parts by Weight |
|---|---|
| Carnauba Wax No. 1 (m.p. 89° C.) made by Noda Wax Co., Ltd. | 10 |
| Surfactant (Trademark "Gemapol V2902" made by Hoechst) | 5 |
| Toluene | 50 |

Thermal printing was performed on this thermosensitive image transfer recording mediums in the same manner as in Example 1. As a result, images having almost the same image gradation as that obtained in Examples 1 and 2 were obtained.

EXAMPLE 10

Example 2 was repeated except that the formulation of the thermofusible top layer coating liquid in Example 2 was changed as follows, whereby a thermosensitive image transfer recording medium No. 10 according to the present invention.

| [Formulation of Thermofusible Top Layer Coating Liquid] | Parts by Weight |
|---|---|
| Carnauba Wax No. 1 (m.p. 89° C.) made by Noda Wax Co., Ltd. | 10 |
| Surfactant (Trademark "Gemapol V2902" made by Hoechst) | 5 |
| Toluene | 50 |

Thermal printing was performed on this thermosensitive image transfer recording mediums in the same manner as in Example 1. As a result, images having almost the same image gradation as that obtained in Examples 1 and 2 were obtained.

EXAMPLE 11

Example 5 was repeated except that the formulation of the thermofusible top layer coating liquid in Example 5 was changed as follows, whereby a thermosensitive image transfer recording medium No. 11 according to the present invention.

| [Formulation of Thermofusible Top Layer Coating Liquid] | Parts by Weight |
|---|---|
| Ethylene - vinyl acetate copolymer | 10 |
| Surfactant (Trademark "Nissan Nonion LP-20R" made by Nippon Oils & Fats Co., Ltd.) | 5 |
| Toluene | 50 |

Thermal printing was performed on this thermosensitive image transfer recording mediums in the same manner as in Example 1. As a result, images having almost the same image gradation as that obtained in Examples 1 and 2 were obtained.

EXAMPLE 12

Example 6 was repeated except that the formulation of the thermofusible top layer coating liquid in Example 6 was changed as follows, whereby a thermosensitive image transfer recording medium No. 12 according to the present invention.

| [Formulation of Thermofusible Top Layer Coating Liquid] | Parts by Weight |
|---|---|
| Ethylene - vinyl acetate copolymer | 10 |
| Surfactant (Trademark "Nissan Nonion LP-20R" made by Nippon Oils & Fats Co., Ltd.) | 5 |
| Toluene | 50 |

Thermal printing was performed on this thermosensitive image transfer recording mediums in the same manner as in Example 1. As a result, images having almost the same image gradation as that obtained in Examples 1 and 2 were obtained.

According to the present invention, an improved thermosensitive image transfer recording medium is provided, from which the shortcomings of the conventional recording media have been eliminated, and which is particularly capable of yielding images with high image quality and excellent image gradation, even on a receiving sheet having a rough surface. The thermosensitive image transfer recording medium according to the present invention can also be used for full-color image formation by appropriate choice of colorants.

What is claimed is:

1. A thermosensitive image transfer recording medium comprising:

(i) a support material;

(ii) a thermofusible ink layer formed on said support material, comprising (a) a fine porous network structure made of a resin, and (b) a thermofusible ink composition which is held in said fine porous network structure, comprising a thermofusible material which is solid at room temperature, a colorant, and an oil component and (iii) a thermofusible top layer comprising an oleophilic thermofusible material formed on said thermofusible ink layers, said thermofusible top layer further comprising a surfactant.

2. The thermosensitive image transfer recording medium as claimed in claim 1, wherein said oleophilic thermofusible material is a wax.

3. The thermosensitive image transfer recording medium as claimed in claim 2, wherein wax is selected from the group consisting of carnauba wax, paraffin wax, microcystalline wax and castor wax.

4. The thermosensitive image transfer recording medium as claimed in claim 1, wherein said oleophilic thermofusible material is a higher fatty acid.

5. The thermosensitive image transfer recording medium as claimed in claim 4, wherein said higher fatty acid is selected from the group consisting of stearic acid, palmitic acid and lauric acid.

6. The thermosensitive image transfer recording medium as claimed in claim 1, wherein said oleophilic thermofusible material is a metal salt of a higher fatty acid.

7. The thermosensitive image transfer recording medium as claimed in claim 6, wherein said metal salt of a higher fatty acid is selected from the group consisting of aluminum stearate, lead stearate, barium stearate, zinc stearate, and zinc palmitate.

8. The thermosensitive image transfer recording medium as claimed in claim 1, wherein said oleophilic thermofusible material is an ester of a higher fatty acid.

9. The thermosensitive image transfer recording medium as claimed in claim 8, wherein said ester of a higher fatty acid is selected from the group consisting of methylhydroxy stearate and glycerol monohydroxy stearate.

10. The thermosensitive image transfer recording medium as claimed in claim 1, wherein said oleophilic thermofusible material is a polymeric material selected from the group consisting of polyethylene, polypropylene, polyisobutylene, polyethylene oxide, polytetrafluoroethylene, ethylene - acrylic acid copolymer, ethylene - ethyl acrylate copolymer, and ethylene - vinyl acetate copolymer.

11. The thermosensitive image transfer recording medium as claimed in claim 1, wherein the amount of said oil component in said thermofusible ink component is 20 wt. % or more.

12. The thermosensitive image transfer recording medium as claimed in claim 1, wherein said oleophilic material has a melting or softening point of about 120° C. or less.

13. The thermosensitive image transfer recording medium as claimed in claim 1, wherein said surfactant is a cationic surfactant.

14. The thermosensitive image transfer recording medium as claimed in claim 1, wherein said surfactant is an anionic surfactant.

15. The thermosensitive image transfer recording medium as claimed in claim 1, wherein said surfactant is a nonionic surfactant.

16. The thermosensitive image transfer recording medium as claimed in claim 1, wherein said surfactant is an ampholytic surfactant.

* * * * *